United States Patent [19]

Komyati

[11] 4,044,277

[45] Aug. 23, 1977

[54] MECHANICALLY ASSEMBLED BASE FOR ELECTRIC LAMPS

[75] Inventor: William J. Komyati, Mentor, Ohio

[73] Assignee: General Electric Company, Schenectady, N.Y.

[21] Appl. No.: 689,635

[22] Filed: May 24, 1976

[51] Int. Cl.[2] ..... H01J 5/48; H01J 5/50

[52] U.S. Cl. ..... 313/318; 313/315; 339/145 R; 339/146

[58] Field of Search ..... 313/315, 318; 339/145 R, 146

[56] References Cited

U.S. PATENT DOCUMENTS

| | | | |
|---|---|---|---|
| 1,437,723 | 12/1922 | Coughlin | 313/318 |
| 2,134,472 | 10/1938 | Criger et al. | 313/318 |
| 3,356,984 | 12/1967 | Thorington et al. | 313/318 |
| 3,534,217 | 10/1970 | Vause et al. | 313/318 |
| 3,629,640 | 12/1971 | Audesse | 313/318 |

*Primary Examiner*—Saxfield Chatmon, Jr.
*Attorney, Agent, or Firm*—Paul F. Wille; Lawrence R. Kempton; Frank L. Neuhauser

[57] ABSTRACT

A mechanically assembled base is disclosed in which the insulator portion comprises an undercut for supporting the portion of the base shell holding the insulator in place.

10 Claims, 4 Drawing Figures

MECHANICALLY ASSEMBLED BASE FOR ELECTRIC LAMPS

BACKGROUND OF THE INVENTION

This invention relates to bases for electric lamps and, in particular, to an improved base having reduced cost in terms of the material and energy used in the manufacture of the base.

Lamp bases are presently manufactured as completely assembled components in which a shell and eyelet are held in a mold into which molten glass is fed to form the insulator therebetween. As known in the art, this method of manufacture has some problems associated with it, viz, cracked or broken insulators and weakened base shells due to the annealing by the glass.

Various alternatives have been proposed for making bases, including mechanically assembled bases. In U.S. Pat. No. 3,775,634, several of these alternatives are noted along with a description of a mechanically assembled base in which a flange and groove at the lower end of the base shell are used to lock the previously formed insulator into place.

As known in the art, one of the advantages of the mechanically assembled base is that thinner material can be used for the shell. While the percent difference is small, that difference multiplied by the number of bases produced represents a considerable savings in material in the course of a year. Actually, the savings are somewhat greater since every base that is made does not wind up in a finished lamp.

However, reducing the amount of material in a base shell may result in cracking or tearing of the shell material. As is known in the art, working a metal increases its strength at the expense of increased brittleness. Forming the basefrom a blank increases the hardness of the already thinned material. Thus, subsequent working, e.g., rolling or turning, may result in the tool penetrating the shell. In the referenced patent, for example, the groove holding the insulator in place must be carefully formed to avoid penetrating the shell wall.

SUMMARY OF THE INVENTION

In view of the foregoing, it is therefore an object of the present invention to provide an improved base for electric lamps.

It is another object of the present invention to provide a mechanically assembled lamp base.

A further object of the present invention is to provide a mechanically assembled lamp base in which the insulating portion of the base supports the shell while the shell is rolled.

Another object of the present invention is to provide an improved lamp base wherein the insulator is formed with an annular undercut for holding the insulator in place.

The foregoing objects are achieved in the present invention wherein the insulator comprises a part having a conical portion and a cylindrical portion in which the cylindrical portion contains an annular groove or undercut by which the variously shaped shells hold the insulator in place.

For example, where the insulator has an outside diameter (o.d.) approximately the same size as the inside diameter (i.d.) of the shell, the shell can be rolled or turned to form a bead engaging the groove. The flange end of the shell is turned to follow the taper of the conical portion of the insulator. In this way, the shell is supported during the subsequent turning operations, reducing the chances of damaging the shell. Alternative embodiments similarly reduce the risk of damaging the shell.

BRIEF DESCRIPTION OF THE DRAWINGS

A more complete understanding of the present invention can be obtained by considering the following detailed description in conjunction with the accompanying drawings, in which.

DESCRIPTION OF THE PREFERRED EMBODIMENTS

Figure 1:
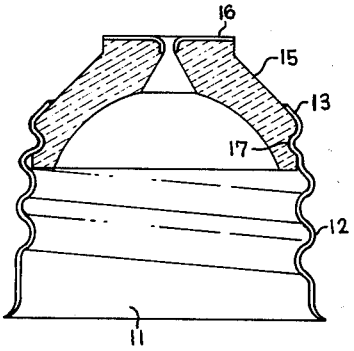
FIG. 1 illustrates a preferred embodiment of the present invention.

Referring to FIG. 1, base shell 11 has a threaded portion 12 and a flange end portion 13 which is turned or rolled inwardly to provide a reduced diameter opening for receiving insulator 15.

Insulator 15 in accordance with the present invention is separately formed from any suitable non-conductive material such as ceramic, glass, or plastic. The insulator is molded or shaped by any suitable means known in the art to produce a button-like article having one or more apertures, depending upon the number of filaments in the lamp, and having a cylindrical portion merged with a conical portion terminated in a plateau for receiving one or more conductive contacts such as contact 16. Contact 16 comprises a hole for receiving one of the leads from the filament which may then be soldered or welded thereto. Contact 16 may be conveniently attached to insulator 15 by flaring the hole therein to engage the corresponding hole in insulator 15. The cylindrical portion of insulator 15 contains an annular groove or undercut 17. While illustrated in FIG. 1 as having a semicircular cross section, undercut 17 may have any suitable cross section, depending upon how insulator 15 is to be attached to shell 11.

In fabricating bases in accordance with the present invention, conductive contact 16 is attached to insulator 15 by any suitable means, such as described above. Insulator 15 is then inserted into shell 11 so that the conical portion thereof engages flange 13 to provide a self-centering seating action. Shell 12 is then rolled or turned against a suitable tool to deform a portion of the shell to engage undercut 17 about the perimeter thereof. As previously noted, by using a mechanically assembled base, shell 11 may comprise thinner material. However, the work hardening of the metal, resulting from a blank being formed into the base shell, increases the chances of damaging the shell during subsequent reworking. By forming the bead against undercut 17, the metal is supported and the risk of damage to the shell is reduced. Thus, undercut 17 provides two functions: locking the insulator in place and supporting the metal during the deformation thereof to engage insulator 15.

Figure 2:
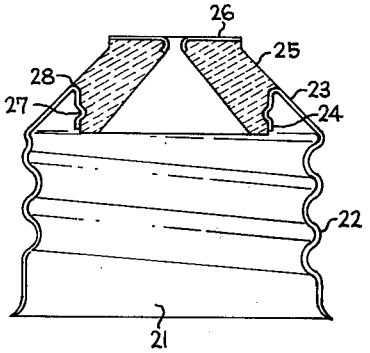
FIG. 2 illustrates an alternative embodiment of the present invention.

Referring to FIG. 2, shell 21 is similar to shell 11 in having a threaded portion 22 and a flange end 23 turned in to form a reduced diameter opening. However, in the embodiment of FIG. 2, shell 21 further comprises a reentrant portion 24 formed in the end of flange 23. Insulator 25 and conductive contact 26 are similar to those described in FIG. 1, except that the diameter of the cylindrical portion of insulator 25 is reduced to fit the diameter of the reentrant opening formed by end 24. In this embodiment of the present invention, insulator 25 is held in place by a bead in end 24 engaging undercut 27. It is preferred that the cylindrical portion of insulator 25 have a slightly reduced diameter from the largest diameter of the conical portion to provide a lip 28 which engages the rim of the reentrant portion of shell 21.

Figure 3:
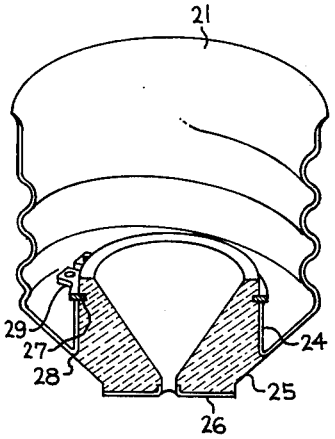
FIG. 3 illustrates an alternative embodiment of the present invention.

FIG. 3 illustrates another embodiment of the present invention utilizing basically the same shell and insulator as the embodiment of FIG. 2, but wherein the insulator is held in place by a snap ring. In this embodiment, insulator 25 is slightly longer, in the direction of the axis of the lamp, so that undercut 27 clears the end of reentrant portion 24. Snap ring 29 is then inserted and engages undercut 27 substantially about the circumference thereof to lock insulator 25 in place.

Figure 4:
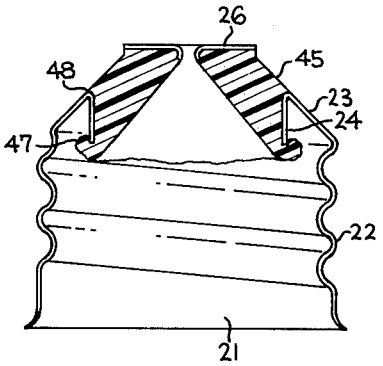
FIG. 4 illustrates an alternative embodiment of the present invention.

FIG. 4 illustrates another alternative embodiment of the present invention utilizing the same base shell as FIGS. 2 and 3. Specifically, shell 21 and contact 26 are combined with a plastic insulator 45 having a cylindrical portion and a conical portion merged therewith and terminated in a plateau for receiving contact 26. The maximum diameter of the conical portion preferably exceeds that of the cylindrical portion to form a rim 48 for engaging the opening to reentrant portion 24. As with insulator 25 in FIG. 3, the length of the cylindrical portion in the direction of the axis of the lamp exceeds the length of end 24. In the embodiment of FIG. 4, the groove or undercut is not formed until after insulator 45 has been inserted into shell 21. Then the innermost end of the cylindrical portion of insulator 45 is deformed to exceed the diameter of the reentrant portion and form a rim 47 engaging end 24. The deformation may be caused by any suitable means such as thermally or ultrasonically.

There is thus provided by the present invention an improved, mechanically assembled base which enables one to use thinner material for the base shell while reducing the risk of damage to the thinner base shell during subsequent assembly operations.

Having thus described the invention, it will be apparent to those of skill in the art that various modifications can be made within the spirit and scope of the present invention. For example, while the insulator is illustrated as having a hollowed-out portion on the interior thereof having either a circular or triangular cross section, it is understood by those of skill in the art that any suitable shape for the hollow portion may be utilized. In addition, while the embodiment of FIG. 1 was described as having flange 13 turned in prior to the insertion of insulator 15, it is understood that the shell could be turned into undercut 17 at the same time that flange end 13 is turned in to form a tapered end. Also, any suitable mechanism may be used to prevent the deliberate rotation of the insulator within the shell, such as, but not limited to, a suitable notch or depression formed in the cylindrical portion of the insulator.

What I claim as new and desire to secure by Letters Patent of the United States is:

1. A mechanically assembled base for an electric lamp comprising:

a base shell having an inwardly tapered end portion;

a hollow insulator having a cylindrical portion having an annular groove and a conical portion having the base thereof merging with said cylindrical portion, the taper of said conical portion being approximately the same as the taper of the end portion of said shell, said conical portion terminating in a plateau;

conductive contact means positioned on said plateau and attached to said insulator; and means for engaging said groove for attaching said insulator to said shell.

2. The base as set forth in claim 1 wherein said shell is threaded.

3. The base as set forth in claim 2 wherein said tapered end portion of said shell overlies part of the conical portion of said insulator.

4. The base as set forth in claim 3 wherein said engaging means comprises a bead located in said shell between said flange and said opposite end.

5. The base as set forth in claim 3 wherein the end of said flange is curved inward to form a reentrant opening.

6. The base as set forth in claim 5 wherein said engaging means comprises a bead formed in said reentrant opening.

7. The base as set forth in claim 5 wherein said engaging means comprises a snap ring.

8. The base as set forth in claim 7 wherein the diameter of the base of said conical portion exceeds the diameter of said cylindrical portion of said insulator.

9. The base as set forth in claim 5 wherein said engaging means comprises the end of said flange forming said reentrant opening.

10. The base as set forth in claim 9 wherein the diameter of the base of said conical portion exceeds the diameter of said cylindrical portion of said insulator.

* * * * *